United States Patent [19]

Gomes

[11] Patent Number: 4,720,022

[45] Date of Patent: Jan. 19, 1988

[54] BEVERAGE CAN OPENING AND SEALING TAB

[76] Inventor: Rodney A. Gomes, 1760 Hookupa St., Pearl City, Hi. 96782

[21] Appl. No.: 853,398

[22] Filed: Apr. 18, 1986

[51] Int. Cl.[4] ..... B65D 17/34

[52] U.S. Cl. ..... 220/269; 220/336

[58] Field of Search ..... 220/269–273, 220/336

[56] References Cited

U.S. PATENT DOCUMENTS 4,433,792 2/1984 Mandel ..... 220/336

4,605,141 8/1986 Won ..... 220/336

*Primary Examiner*—George T. Hall

*Attorney, Agent, or Firm*—James C. Wray

[57] ABSTRACT

A beverage can is provided with a tab having opening and sealing portions. The tab is riveted to the can lid in a central portion thereof with the opening portion being adjacent an openable area of the can lid which is defined by a continuous score line.

The can is opened by lifting the sealing portion of the tab which causes downward movement of the opening portion which in turn impinges upon the openable area of the lid until an opening is formed. After forming the opening, the tab is rotated 180 degrees until the sealing recoverable portion is juxtaposed over the opening, thus covering the opening to keep out foreign matter. The tab is then pushed downwardly so that the sealing portion is fitted into the opening, thereby affecting a seal.

18 Claims, 7 Drawing Figures

FIG. 1
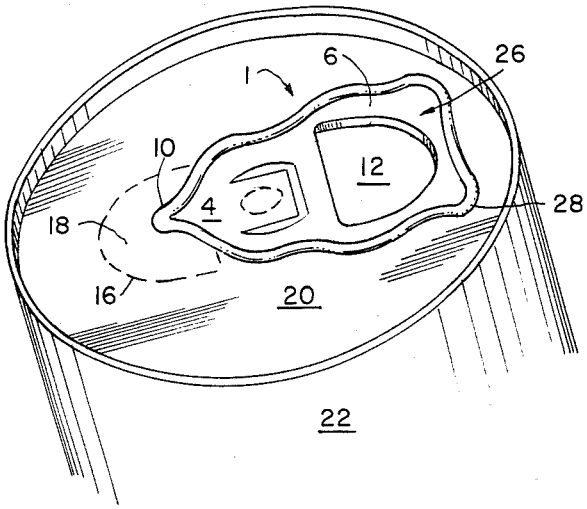
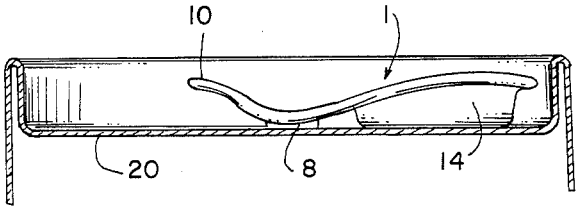
FIG. 2
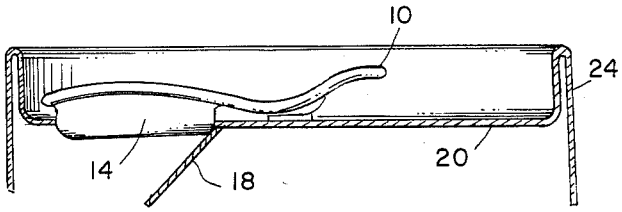
FIG. 3

BEVERAGE CAN OPENING AND SEALING TAB

BACKGROUND OF THE INVENTION

The present invention relates generally to beverage cans and more specifically to cans having resealable openings.

It is known to make beverage cans out of metal, preferably aluminum stampings, with the lid of the cans being provided with drinking spouts or openings which are formed by tabs mounted adjacent the opening.

An opening tab that is rapidly becoming obsolete is the type having a finger ring riveted to an inward end of the tab, which is defined by a continuous score line in the lid. To open the can, the finger ring is lifted and then pulled toward a circumferential edge of the lid until the entire tab and finger ring assembly is removed, thereby forming an opening.

Because these removable tabs were a source of litter and presented safety problems, a can opening tab was developed whereby the tab pushes downwardly on an openable area of the lid defined by a continuous score line. The openable area of the lid, when sufficient force is applied through the tab, pivots downwardly into the can but remains attached to the can by an edge of the openable area adjacent the tab.

The aforementioned tab has many advantages over the prior art including the fact that after opening the can, the tab remains attached to the lid and thereby does not present a health hazard or a litter problem.

A problem persists in the art however, in that after opening, the cans cannot be resealed and there presently is no way to cover the opening completely to keep out foreign matter. Since bottles are easily resealable and recoverable to keep out foreign matter, this persistent disadvantage hinders the full marketability and usefulness of beverage cans. Without a resealable and recoverable capacity, carbonated beverages cannot be stored without becoming flat and cannot be made to keep out foreign matter. Also, when the beverage cans are used outdoors, an additional health risk is presented because of insects that tend to enter the beverage can through the unsealed opening. This could prove fatal where stinging insects such as bees or wasps enter the beverage can and can be swallowed.

While some attempts have been made to make beverage cans open easier, be recoverable and be resealable, these attempts have failed either because they are impractical or not cost effective. Also, it is desirable to have an easy opening, resealable, recoverable feature added to a beverage can without the need for separate implements or costly design changes.

SUMMARY OF THE INVENTION

The present invention solves the problem associated with the prior art by providing a beverage can with a non-removable tab that can both open easily, reseal and recover the beverage can.

The tab can be stamped out of a soft metal, such as aluminum. By stamping the tab, no assembly is necessary and the tab can be manufactured cost effectively.

It is an object of this invention to provide a novel, multiple purpose tab that is both easy to manufacture and easy to use.

Another object of this invention is to provide easy opening, coverable and reseable beverage cans that are inexpensive and will prevent foreign matter from entering the can and which will also help prevent carbonated drinks from becoming flat.

Generally, the beverage can easy opening, coverable and resealable tabs of the present invention comprise a one piece body having an easy can opening portion, a coverable and a can sealing portion, and attachment means for rotatably connecting the one piece body to a beverage can lid adjacent an openable portion of the lid, the attachment means providing both a vertical and horizontal rotational axis for the one piece body. Rotational movement of the one piece body about the horizontal rotational axis causes the can opening portion to move downwardly and impinge upon the openable portion of the can lid, thereby exerting opening force to create an opening. After forming an opening, rotational movement about the vertical rotational axis of the body by about 180 degrees causes the can sealing and recoverable portion to be juxtaposed over the opening, such that the opening can be resealed by fitting the can sealing portion tightly into the opening by pushing downward.

Preferably, the one piece body is made of a single metal stamping.

In another embodiment, the tabs have a cut away portion between the can opening portion and recoverable can sealing portion of the one piece body, defining a hinge through which the attachment means extends.

Preferably, the hinge is integral with the one piece body and the hinge is flexible.

In one embodiment, the attachment means is a rivet extending through the hinge and the can lid.

The sealing recoverable portion of the one piece body preferably has a countersunk portion having an outer side wall corresponding in shape to a peripheral edge of the can opening and the can opening portion comprises a pointed end of the one piece body generally inclined upwardly from the attachment means. The sealing recoverable portion has a relatively flat lifting portion surrounding the countersunk portion, and a peripheral flange surrounding the lifting portion.

Preferably, the tab has a raised anular rim extending upwardly from the can lid a distance greater than the height of the inclined pointed end of the one-piece body.

The present invention also contemplates a method of easy opening, recovering and resealing a beverage can comprising lifting upwardly a sealing portion of a can tab mounted to a can lid whereby an opposite opening portion of the can tab moves downwardly and impinges upon an openable area of the can lid defined by a score line, thereby forming an opening in the can lid, returning the can tab approximately back to its original, horizontally disposed position, rotating the can tab approximately 180 degrees, thereby juxtaposing the sealing recoverable portion of the can tab over the can opening, and by pushing the sealing portion of the can tab downwardly into the opening thereby achieving a tight, interference fit.

Preferably, the method further comprises pushing downwardly on the opening portion prior to lifting the sealing portion, whereby the sealing portion moves upwardly to allow easy and better gripping for the lifting step.

Preferably, the sealing portion of the can tab comprises a countersunk portion having a bevelled sidewall corresponding in shape to a peripheral edge of the opening to allow for easier resealing. Also, the can tab is attached to the can lid by attachment means disposed between the sealing and opening portion of the can tab.

In another embodiment of the method, the attachment means comprises a cut away portion of the can tab disposed between the sealing, recoverable and opening portion of the can tab, the cut away portion defining a hinge integrally formed with the can tab, and a rivet extending through the hinge and the can lid, wherein the opening portion of the can tab comprises an inclined pointed end of the can tab.

In another embodiment of the invention, a beverage can comprises a cylindrical body, a bottom at one end of the cylindrical body and a lid at the opposite end, the lid comprising an openable portion defined by a continuous score line, the openable portion being disposed adjacent a circumferential edge of the lid, and a can opening and sealing tab being approximately horizontally disposed with respect to the lid and being rotatably connected to the lid by attachment means at a center of the lid and having an opening portion adjacent the openable portion and a sealing portion oppositely disposed from the opening portion, whereby the openable portion, attachment means, opening portion and sealing portions are approximately aligned, whereby when the sealing recoverable portion is lifted, the opening portion impinges upon the openable area to the extent that an opening is formed, and after the opening is formed it may be recovered or sealed by rotating the can tab 180 degrees to juxtapose the sealing recoverable portion over the opening, and pushing the sealing portion downwardly into the opening.

In another embodiment, the attachment means comprises, a cut away portion of the can tab disposed between the opening portion and sealing recoverable portion, thereby defining a hinge, and a rivot extending through the hinge and the can lid.

In another embodiment, a raised annular rim extends upwardly beyond the can tab to provide can stacking means.

Preferably, the raised annular rim is integrally formed with the cylindrical body.

BRIEF DESCRIPTION OF THE DRAWINGS

FIG. 1 is a perspective view of an upper portion of a beverage can embodying the present invention.

FIG. 2 is a side view, partially in section of the embodiment of FIG. 1.

FIG. 3 is the same view as FIG. 2 except that the tab has been rotated 180 degrees.

DETAILED DESCRIPTION OF THE DRAWINGS

Figure 4:
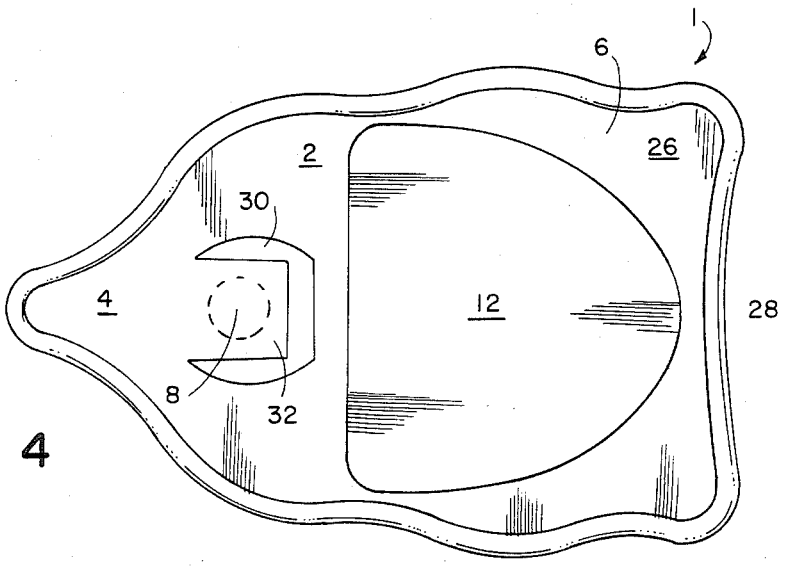
FIG. 4 is a top view of the tab apart from the can.

Referring to FIG. 1, a tab is generally designated as 1. The tab 1 comprises a one piece body 2 having an opening portion 4 and a sealing recoverable portion 6.

As shown in FIG. 2, the tab 1 is attached to the can lid 20 by attachment means that include rivet 8.

The opening portion 4 terminates in a point 10 at one end of the body 2.

Prior to opening of the can, the point 10 is disposed adjacent an openable area 18 of the lid 20. The openable area 18 is defined by a score line 16 which provides a weakend boundary so that the openable area 18 can be pushed downwardly into the can, as shown in FIG. 3 after the point 10 impinges upon the openable area 18.

After an opening is formed, the opening will have a peripheral edge where the score line was previously provided. The opening will, of course, have a size equal to the openable area 18.

The sealing recoverable portion 6 preferably has a countersunk portion 12 which has an outer sidewall 14.

After opening the can, which involves lifting upwardly the sealing recoverable portion 6 such that the opposite point 10 impinges the openable area 18 with sufficient force to drive the openable portion 18 into the can, the tab 1 is preferably returned to its generally horizontal initial position and then rotated 180 degrees or until the sealing recoverable portion 6, and more specifically the countersunk portion 12, is juxtaposed over the opening. The countersunk portion 12 and the sidewall 14 have a size that is bevelled and corresponds to the size of the opening, after juxtaposition, the countersunk portion 12 is pushed into the opening. The sidewall 14 and a peripheral edge of the opening provide an interference fit which maintains the tab in a sealing engagement.

Since the point 10 is necessarily inclined above the horizontal surface of the lid 20, to allow easy opening, and since the sealing portion 6 necessarily requires a width-wise dimension, the can 22 is preferably provided with a raised annular rim 24 that extends upwardly beyond the opening and sealing portion of the tab 1. This allows the cans to be vertically stacked on top of each other without the tab 1 interfering with a bottom of a stacked can.

Preferably, the sealing recoverable portion further comprises a relatively flat, lifting portion 26 which facilitates lifting of the sealing portion with a single finger. The lifting portion 26 has a peripheral flange 28 that also aides in lifting and further provides a stiffening means to give the tab strength.

Referring now to FIGS. 4–7, the tab 1 is shown in greater detail.

A cut away portion 30 is provided between the opening portion 4 and the sealing portion 6. The cutaway portion defines a hinge 32 that is integrally formed with the body 2.

The rivet 8 passes through the hinge 32 and the lid 20, thereby attaching the tab 1 to the lid 20.

Figure 5:
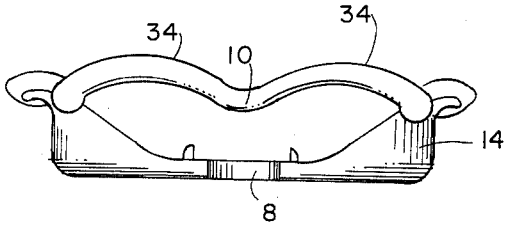
FIG. 5 is a front view of the embodiment of FIG. 4.

Referring to FIG. 5, the opening portion 4 is provided with opposite converging side portions 34 which terminate in the point 10. The converging side portions provide easy opening and strength for the point necessary to open the can.

Figure 6:
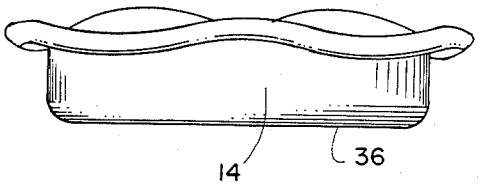
FIG. 6 is a rear view of the embodiment of FIG. 4.
Figure 7:
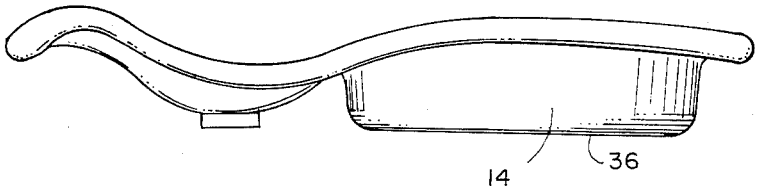
FIG. 7 is a side view of the embodiment of FIG. 4.

FIG. 6 and FIG. 7 provide a more detailed viewing of the sidewall 14. It should be understood that the countersunk portion 12 will provide a bottom surface 36 which, in conjunction with the side wall 14, effectively-seals the opening when necessary.

Minor changes in shape, size, materials, and rearrangement of parts may be resorted to in actual practice so long as no departure is made from the invention as claimed.

I claim:

1. An easy opening beverage can resealable, recoverable tab comprising, a one piece body having a can opening portion and a can sealing recoverable portion, and attachment means for rotatably connecting the one piece body to a beverage can lid adjacent an openable portion of the lid, the attachment means providing both a vertical and horizontal rotational axis for the one piece body, whereby rotational movement of the one piece body about the horizontal rotational axis causes the can opening portion to move downwardly and impinge upon the openable portion of the can lid, thereby exerting opening force to create an opening, and whereby after forming an opening, rotational movement about the vertical rotational axis of the body by about 180 degrees causes the can sealing recoverable portion to be juxtaposed over the opening, to keep out foreign matter, and whereby the opening can be resealed by fitting and pushing downward the can sealing recoverable portion tightly into the opening, wherein the sealing recoverable portion of the one piece body has a countersunk bevelled portion having an outer side wall corresponding in shape to a peripheral edge of the can opening, the countersunk bevelled portion being insertable into the can opening and being held in the opening by an interference fit, wherein the can opening portion comprises an upwardly inclined pointed end of the one piece body.

2. The device of claim 1 wherein the one piece body is made of a metal stamping.

3. The device of claim 2 further comprising, a cut-away portion between the can opening portion and can sealing recoverable portion of the one piece body, defining a hinge through which the attachment means extends.

4. The device of claim 3 wherein the hinge is integral formed with the one piece body.

5. The device of claim 4 wherein the hinge is flexible.

6. The device of claim 3 wherein the attachment means is a rivet extending through the hinge and the can lid.

7. The device of claim 1 wherein the sealing portion has a relatively flat lifting portion surrounding the countersunk portion, and a peripheral flange surrounding the lifting portion.

8. The device of claim 1 wherein the can further comprises a raised anular rim extending upwardly from the can lid a distance greater than the height of the inclined pointed end of the one piece body.

9. A method of easy opening, resealing and recovering a beverage can comprising, lifting upwardly a sealing portion of a can tab mounted thereto whereby an opposite opening portion having an inclined pointed end of the can tab moves downwardly and impinges upon an openable area of the can lid defined by a score line, thereby forming an opening in the can can lid, returning the can tab approximately back to its original, horizontally disposed position.

rotating the can tab approximately 180 degrees, thereby juxtaposing the sealing recoverable portion of the can tab over the can opening, and pushing the sealing portion of the can tab downwardly into the opening thereby achieving a tight, interference fit.

10. The method of claim 9 further comprising pushing downwardly on the easy opening portion prior to lifting the sealing portion, whereby the sealing portion moves upwardly to allow better griping for the lifting step.

11. The method of claim 9 wherein the sealing portion of the can tab comprises a countersunk portion having a bevelled sidewall corresponding in shape to a peripheral edge of the opening.

12. The method of claim 11 wherein the can tab is attached to the can lid by attachment means disposed between the sealing and opening portion of the can tab.

13. The method of claim 12 wherein the attachment means comprises a cut away portion of the can tab disposed between the sealing and opening portion of the can tab, the cut away portion defining a hinge integrally formed with the can tab, and a rivet extending through the hinge and the can lid.

14. The method of claim 11 wherein the easy opening portion of the can tab comprises an inclined pointed end of the can tab.

15. A beverage can comprising a cylindrical body, a bottom at one end of the cylindrical body and a lid at the opposite end, the lid comprising, an openable portion defined by a continuous score line, the openable portion being disposed adjacent a circumferential edge of the lid, and a can opening and sealing tab being approximately horizontally disposed with respect to the lid and being rotatably connected to the lid by attachment means at a center of the lid and having an opening portion adjacent the openable portion and a sealing recoverable portion oppositely disposed form the opening portion, whereby the openable portion, attachment means, opening portion and sealing recoverable portions are approximately aligned, whereby when the sealing recoverable portion is lifted, the opening portion impinges upon the openable area to the extent that an opening is formed, and after the opening is formed it may be sealed or covered by rotating the can tab 180 degrees to juxtapose the sealing recoverable portion over the opening, and pushing the sealing portion downwardly into the opening.

16. The device of claim 15 wherein the attachment means comprises, a cut away portion of the can tab disposed between the opening portion and sealing recoverable portion, thereby defining a hinge and a rivet extending through thehinge and the can lid.

17. The device of claim 16 further comprising a raised anular rim extending upwardly beyond the can tab to provide can stacking means.

18. The device of claim 17 wherein the raised annular rim is integrally formed with the cylindrical body.

* * * * *